US007311030B2

(12) United States Patent
Renaud

(10) Patent No.: US 7,311,030 B2
(45) Date of Patent: Dec. 25, 2007

(54) METHOD OF OPTIMIZING BRAIDING CONTROL PARAMETERS FOR A SHEATH FOR SHIELDING A BUNDLE OF ELECTRICAL CONDUCTORS, AND A BUNDLE AS OBTAINED IN THIS WAY

(75) Inventor: Thierry Renaud, La Fare les Oliviers (FR)

(73) Assignee: Eurocopter, Marignane (FR)

( * ) Notice: Subject to any disclaimer, the term of this patent is extended or adjusted under 35 U.S.C. 154(b) by 98 days.

(21) Appl. No.: 11/143,636

(22) Filed: Jun. 3, 2005

(65) Prior Publication Data

US 2006/0070517 A1 Apr. 6, 2006

(30) Foreign Application Priority Data

Jun. 3, 2004 (FR) ..... 04 06019

(51) Int. Cl.
*D04C 3/00* (2006.01)

(52) U.S. Cl. ..... 87/8; 87/13; 87/33; 87/62

(58) Field of Classification Search ..... 87/8, 87/9, 11, 13, 33, 62; 700/130
See application file for complete search history.

(56) References Cited

U.S. PATENT DOCUMENTS

| | | | | |
|---|---|---|---|---|
| 4,535,672 | A * | 8/1985 | Bull et al. | 87/29 |
| 4,620,473 | A * | 11/1986 | Bull | 87/48 |
| 6,255,584 | B1 * | 7/2001 | Renaud | 174/36 |
| 2001/0011601 | A1 * | 8/2001 | Renaud | 174/102 R |
| 2004/0002783 | A1 * | 1/2004 | St. Ville | 700/98 |

FOREIGN PATENT DOCUMENTS

| | | |
|---|---|---|
| FR | 2 731 294 | 9/1996 |
| WO | WO 96/42091 | 12/1996 |

* cited by examiner

*Primary Examiner*—Shaun R. Hurley
(74) *Attorney, Agent, or Firm*—Young & Thompson

(57) ABSTRACT

The present invention relates to a method of optimizing setting parameters for braiding a shielding sheath using spindles carrying coils of wires on a braiding machine, the sheath being braided onto a bundle of electrical conductors, and the invention also relates to such a bundle. According to the invention, the method consists in determining for each diameter in a series (s1) of consecutive electrical conductor bundle diameters, a single group (N) of spindles and a single group (M) of braiding wires so as to minimize the number of actions that need to be taken in order to adapt the machine to braiding a required diameter.

13 Claims, 1 Drawing Sheet

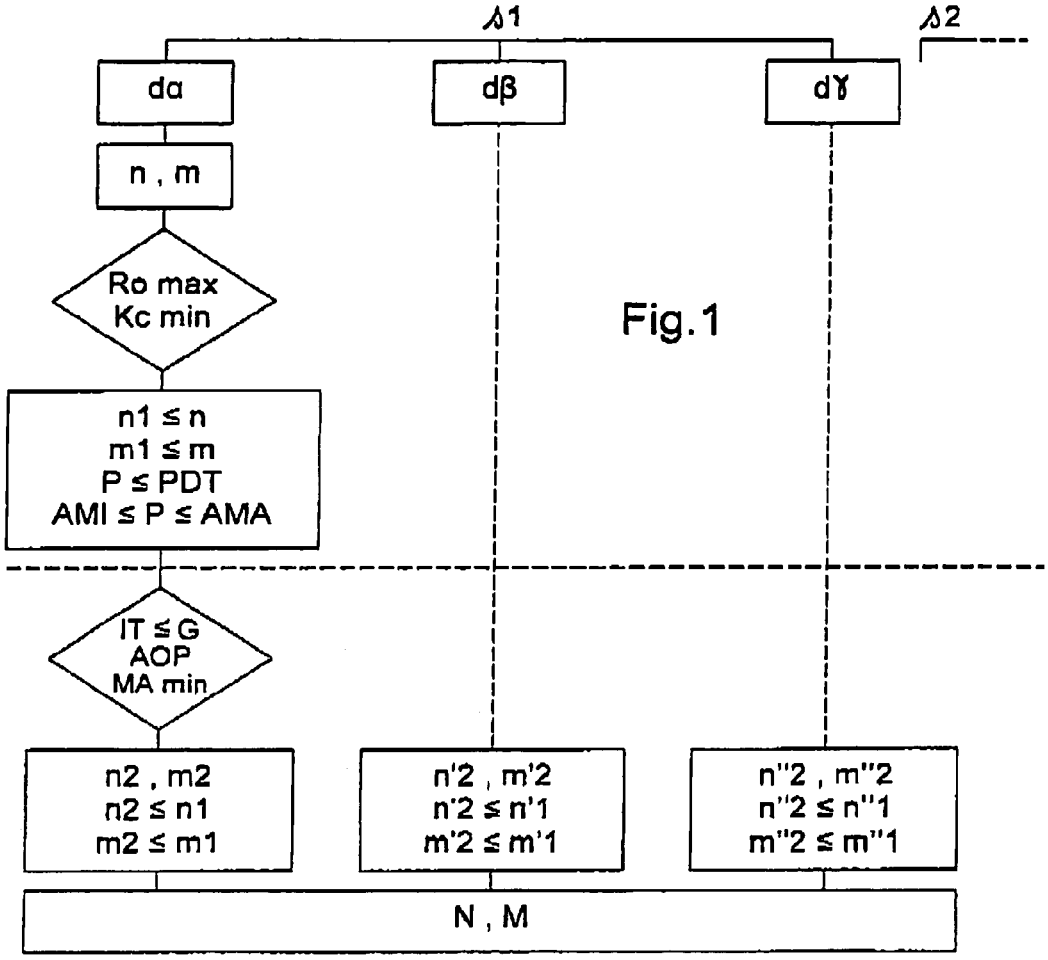
Fig.1
Fig.2
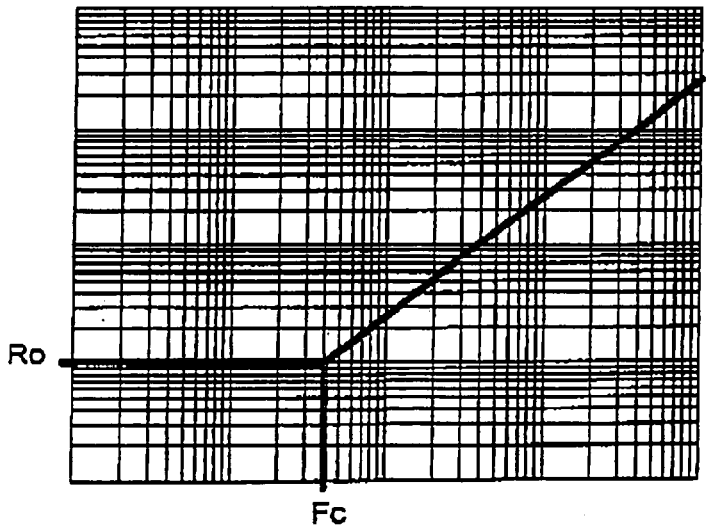

METHOD OF OPTIMIZING BRAIDING CONTROL PARAMETERS FOR A SHEATH FOR SHIELDING A BUNDLE OF ELECTRICAL CONDUCTORS, AND A BUNDLE AS OBTAINED IN THIS WAY

The present invention relates to a method of optimizing braiding adjustment parameters for a sheath for shielding a bundle of electrical conductors.

BACKGROUND OF THE INVENTION

It is known that bundles of electrical conductors, also known as cabling harnesses, can be subjected to a protective hardening operation corresponding to providing shielding against electromagnetic interference (EMI), in particular when they are used in civilian or military applications relating to aviation and space, or to shipping, and when mounted on board vehicles such as aircraft, ships, tanks, etc. . . . . Such a protective sheath serves to avoid malfunction of an electrical installation having various devices interconnected by such cable harnesses.

Naturally, the invention is not limited to this particular application and it relates more generally to making sheaths for improving the mechanical strength of elongate objects such as cables, etc.

In the specific application of the invention, in order to make such shielding, it is possible to perform braiding directly on harnesses, and thus on the various branches making up each harness, thereby producing sheaths that are obtained by braiding textile and/or metal strands and/or wires, as described for example in French patent applications Nos. 94 14968 and 94 14969 in the name of the Applicant.

Those shielding sheaths are made using a braiding machine of the kind described, for example, in French patent No. FR 2 742 772, also in the name of the Applicant, and comprising:

- a bench through which said bundle for shielding can pass;
- means for advancing said bundle along a braiding axis perpendicular to said bench;
- a plurality of spindles mounted on supports regularly distributed on said bench around said passage, and carrying respective reels from which the braiding wires are entrained towards said bundle for braiding; and
- drive means associated with said bench and suitable for driving said spindle supports along slideways provided in said bench.

Thus, by causing the support and spindle assemblies to move circularly along the slideways around said passage while simultaneously actuating the advance means, the wires pulled from the reels by the bundle progressively build up the braid around said bundle. Such circular displacement of the spindle-and-support assemblies then enables substantially circular braids to be made. Nevertheless, appropriate routes for the slideways also make it possible to make braids around cross-sections that are I-shaped, T-shaped, . . . .

Although those machines give good results and are in widespread use, they nevertheless present certain drawbacks concerning more particularly their preparation and setting operations which are a function of the configuration to be given to the braiding, and also of the material that is to be used, and that also depend on the type of harness that is to be fitted with a braid.

Whenever the type and the shape of the braiding to be performed on a harness need to be modified, the resulting operations of preparing and setting the braiding machine turn out to be lengthy and tedious. For example, when a machine initially fitted with a certain number of spindles, each spindle carrying a reel of wire comprising a plurality of same-diameter strands, needs to be subjected to changes in the number of spindles and the associated reels in order to adapt to requirements, and in particular to the diameter of the harness that is to be shielded, to the braiding angles, and to the kind of wires, i.e. the nature of the material that is to be used for braiding, to the number of strands per wire, and to the diameters of said strands, the length of time taken to perform these operations is very penalizing for production. Thus, the time required for such an intervention can be as long as one hour or more.

Naturally, this occurs in theory for one particular application only, with the nature, the diameter, and the number of strands used for braiding being identical regardless of the number of spindles (or reels). Naturally, these characteristics differ as a function of different applications.

Thus, the potential number of interventions can be very large because of the number of setting parameters that need to be taken into account for the braiding machine, and in particular, the parameters listed below:

- harness diameter;
- nature of the material to be braided;
- strand for braiding made of metal, textile, filled composite, metallized composite, . . . ;
- strand diameter (or thickness, or width);
- number of strands being braided: 3 to 11 strands per wire, for example, forming in this particular case nine groups of wires;
- the number of spindles, i.e. of reels: 16, 32, 48, and 64 spindles, for example, forming in this particular case four groups of spindles; and
- the braiding angle (lying in the range 10° to 80°, for example).

It can thus be seen that these operations lead to a long down time for the machine, particularly when a large number of assemblies or of spindle and reel groups need to be changed with possible adjustments of braiding angle, with any down time reducing the overall productivity of the machine itself.

Furthermore, the setting parameters that are selected must be selected in highly rigorous manner in order to comply with electromagnetic protection requirements, particularly when it is understood that modern aircrafts, for example, are being fitted more and more with electronic means that provide an increasing number of functions in ever more automatic manner. Furthermore, these electronic means operate in environmental conditions that are more and more severe in terms of electromagnetic radiation, in particular because of the increasing use of structures made of composite materials that are more permeable to such radiations.

Consequently, the requirements for electromagnetic protection lead to optical coverage and transfer impedance thresholds that must be complied with by the shielding on bundles of electrical conductors.

In parallel, the weight of the shielding must be minimized. On this topic, it should be observed that the weight of the shielding depends in particular on its optical coverage percentage which is defined as being the ratio of the surface area of shielding on a harness (bundle of conductors) over the outside surface area of said harness.

Furthermore, transfer impedance represents linear electrical resistance as a function of the frequency of the electromagnetic radiation. The transfer impedance thus directly characterizes the effectiveness of shielding.

In this context, it should be recalled that two categories of electromagnetic radiation can be distinguished. The first category relates to electromagnetic radiation at a frequency lying in the range zero to 400 megahertz (MHz): such radiation is said to be of the conducted type since it is transmitted all the way to the ends of a harness and runs a risk of damaging items of equipment associated with said harness.

The second category relates to electromagnetic radiation for which energy is dissipated essentially by radiation along the length of the shielding: such radiation is at frequencies greater than 400 MHz. Under such circumstances, items of equipment associated with the harness are under threat only insofar as the higher the frequency, the nearer the electromagnetic attack must occur to said item of equipment. This means that it is possible to provide for a coverage percentage that is locally greater in the vicinity of items of equipment, while possibly reducing said coverage percentage over an ordinary portion of the harness, possibly to below a value that is conventional for such a location.

In an attempt to provide a solution to the problem of electromagnetic radiation of the conducted type, document U.S. Pat. No. 5,504,274 discloses a method of forming shielding that provides protection against electromagnetic radiation that is limited to frequencies of less than 50 MHz. Above that frequency, each item of equipment needs to possess its own protection, which is penalizing in terms of weight.

OBJECTS AND SUMMARY OF THE INVENTION

An object of the present invention is to mitigate those drawbacks and to optimize the productivity of braiding machines, in particular by reducing the time required for changing reels and spindles, while continuing to comply with requirements in terms of the optical coverage, the transfer impedance, and the weight of the shielding. In particular, the invention enables a harness to be protected against electromagnetic radiation up to frequencies of about 400 MHz, i.e. over the entire range of frequencies relating to electromagnetic radiation of the conducted type.

To do this, the present invention relates to a method of optimizing setting parameters for a braiding machine of the type described above, in particular for making a shielding braid around a bundle of electrical conductors or the like. As specified above, it will be understood that the setting parameters correspond in practice, and depending on the nature of the material and the diameter of the strand to be braided, to the following:

- a plurality of harness diameters to be shielded;
- a plurality of groups of spindles, each spindle carrying a reel of braiding wire;
- a plurality of braiding wires (plurality of strands per braiding wire); and
- a plurality of braiding angles.

To this end, according to the invention, said method is remarkable in that:

A/ in a first step I, for each diameter of electrical conductor bundle, a first set of spindle groups and of braiding wire groups is determined for which a range of braiding angles is defined specifically for each wire, each range firstly being defined by minimum and maximum braiding angles lying in a predetermined range of braiding angles, and secondly corresponding to a predetermined maximum value for the DC linear electrical resistance and to a predetermined minimum value for the optical coverage percentage;

B/ in a second step II, for each diameter of electrical cable bundle and for each spindle group associated with each of the braiding wire groups in said first set, it is verified that the corresponding transfer impedance, for each braiding angle lying in said range, lies below a characteristic curve representing the variation in an upper limit for transfer impedance as a function of the frequency of conducted type electromagnetic radiation, and a second set of spindle groups and of braiding wire groups is selected from said first set, so that an optimum braiding angle corresponds to a minimum weight for the shielding sheath; and C/ in a third step III, for each diameter of electrical conductor bundle, a single spindle group and a single braiding wire group is selected from those obtained in said second set together with the corresponding single braiding angle so as to minimize the number of combinations of spindles groups and of braiding wire groups, a different combination being allocated to each different series of consecutive diameters of electrical conductor bundles.

Advantageously, the predetermined maximum value for the DC linear electrical resistance is defined for the shielding in the new state. Thereafter it corresponds to a reduction by a factor k lying in the range 0 to 10 of the value of said DC linear electrical resistance that is acceptable at the end of the duration of use of a shielded harness, taking account of the effects of aging on the equipment in operation. This DC linear electrical resistance generally lies in the range 5 milliohms per meter (mΩ/m) to 200 mΩ/m.

Furthermore, in the invention, the optical coverage percentage is greater than a predetermined minimum value, substantially equal to 50% to satisfy requirements for protection against electromagnetic radiation. Nevertheless, the value of the optical coverage percentage is preferably greater than 80%.

The greater the area of non-covered zones of a harness, the less good the protection provided against electromagnetic interference at high frequencies. Consequently, the higher the frequency of electromagnetic interference against which protection must be provided, the smaller the uncovered zones of a harness must be, which means that the optical coverage percentage must be greater.

In addition, and advantageously, the transfer impedance obtained using the method of the invention for shielding is less than a characteristic curve drawn on a system of coordinates having logarithmic scales to base 10 such that:

- electromagnetic radiation frequency is plotted along the abscissa;
- linear electrical resistance is plotted up the ordinate; and
- the curve comprises:
  - a first straight line segment of ordinate value equal to the maximum predetermined value for the DC linear electrical resistance up to the cutoff frequency; and then
  - a second straight line segment representing a constant rate of increase up to the maximum frequency for conducted type electromagnetic radiation.

Advantageously, the cutoff frequency lies in the range 500 kilohertz (kHz) to 10 MHz, and is preferably close to 1 MHz, and the protection is determined up to a maximum frequency for conducted type electromagnetic radiation, which maximum frequency is about 400 MHz.

Furthermore, the above rate of increase is preferably about 20 decibels per decade (dB/decade). This is necessary in order to take overall account of the diffusion, diffraction, and induction phenomena that are involved in transfer impedance matters.

Naturally, that characteristic curve is defined for the shielding when in the new state, since said first segment has as its ordinate the predetermined maximum value for DC linear electrical resistance.

This new-state characteristic for the shielding is deduced by taking a characteristic that is acceptable at the end of the lifetime of a harness, and shifting it along the ordinate axis to reduce the transfer impedance.

Furthermore, the present invention also provides a single- or multi-branch bundle of electrical conductors covered in a sheath of electromagnetic shielding obtained using the above-described method.

In addition, the present invention also provides a single- or multi-branch bundle of electrical conductors covered in an electromagnetic shielding sheath, wherein the or at least one of the branches has an optical coverage percentage that decreases, e.g. from 100% to 50%, as a function of increasing distance from the electrical connectors associated with the branch in question.

BRIEF DESCRIPTION OF THE DRAWING

The figures of the accompanying drawing make it easy to understand how the invention can be implemented. In the figures, identical references are used to designate elements that are similar.

FIG. 1 is an overall diagram showing the various steps in implementing the method.

FIG. 2 shows an example of a characteristic curve relating to transfer impedance.

MORE DETAILED DESCRIPTION

The method of the invention consists in optimizing the setting parameters for braiding a shielding sheath on a bundle of electrical conductors, and more particularly to minimizing the number of interventions that need to be undertaken when the operator needs to change said setting parameters.

Another object of the invention is to comply with specific conditions that relate to shielding, namely, in particular:

the optical coverage percentage;

the linear electrical resistance;

the transfer impedance; and the weight of the shielding.

It is known that a braiding machine makes use of some number of spindles carrying reels of wire, the wire being constituted by a plurality of strands. Depending on requirements, and in particular on the diameter of the bundle of electrical conductors, the user selects a braiding machine having same particular number of spindles (and thus of reels) and also selects wires having some determined number of strands. In addition, the nature of the material and the diameter of the strands are adapted to the application, as is the braiding angle of the wires.

In the context of the present invention, the user has braiding machines that comprise, as shown in FIG. 1:

n groups of spindles, each group having a different number of spindles (16, 32, 48, . . . , spindles); and m groups of wires, each group having a different number of strands (3, 7, 9, 11, . . . , strands per wire).

Naturally, braiding machines are capable of braiding shielding sheaths onto bundles of electrical conductors that are of different diameters.

The object of the invention is thus to reduce the time required to set braiding parameters between each different type of use, and consequently to reduce the number of setting operations that need to be carried out.

In addition, the setting parameters must be defined in such a manner as to comply with the above-described specific conditions.

To this end, the idea is to determine for each different series s1, s2, . . . of consecutive diameters for bundles of electrical conductors, minimum combinations of groups of spindles and of types of wire (number of strands per wire) that satisfy the specific conditions, with this applying to some particular type of strand (kind of material, strand diameter, in particular).

In FIG. 1, in a first step I, the following are determined:

for each diameter of a series s1 of consecutive diameters covering a range from diameter dα to diameter dγ; and in a set of n groups of spindles (or reels) and of m groups of braiding wires, for example four groups of spindles respectively comprising 16, 32, 48, and 64 spindles, and for example four groups of wires respectively comprising 6, 7, 9, and 11 strands;

a first group of braiding wires making the following possible:

braiding shielding on a diameter dα to have DC linear electrical resistance Ro that is less than a predetermined maximum value (e.g. 20 mΩ/m) and having some minimum value of optical coverage percentage Kc, e.g. 80%; and defining for each wire a braiding angle lying in a range P that is defined by a minimum angle AMI and a maximum angle AMA, said range P itself lying within a predetermined range of braiding angles PDT. The range PDT is such that beyond it, it is practically impossible to perform braiding since the wires then lie substantially in a diametral plane of the harness, or else are substantially parallel to the harness. Such a range PDT generally lies between about 10° to about 80°.

As a result, it is possible to determine n1 groups of spindles and m1 groups of wires per group of spindles satisfying the specific conditions for the characteristics Ro and Kc and also the range P of braiding angles, e.g. on the basis of the numbers given above by way of illustration:

n=4 (16, 32, 48, and 64 spindles);

m=4 (wires of 6, 7, 8, and 9 strands);

n1≦n;

m1≦m.

The solution with 64 spindles might not be suitable. In which case n1 is equal to 3 which corresponds to the use of 16, 32, or 48 spindles.

Under such conditions, the possible solutions correspond to the following nine combinations C1, for example:

| Harness | n1 = 3 | | | | | | | | |
|---|---|---|---|---|---|---|---|---|---|
| diameter | 16 spindles | | | | 32 spindles | | | 48 spindles | |
| dα | m1 = 4 | | | | m1 = 3 | | | m1 = 2 | |
| | 6 strands | 7 strands | 8 strands | 9 strands | 6 strands | 7 strands | 9 strands | 6 strands | 7 strands |

These nine combinations C1 form a first set E1 of spindles and braiding wires relating to the first step for a predetermined diameter of electrical conductor bundles.

In a second step II, for each diameter of an electrical conductor bundle and for each group of spindles and of braiding wires contained in the first set E1, it is verified that the corresponding transfer impedance for each braiding angle lying in the above range P is less than a characteristic curve G representing the variation to be expected in an upper limit for transfer impedance IT as a function of electromagnetic radiation at frequencies of the conducted type, i.e. frequencies lying in the range about 0 to about 400 MHz.

FIG. 2 shows an example of one such characteristic curve G plotted in a system of logarithmic scales to base 10, such that:

electromagnetic radiation frequency is plotted along the abscissa;

linear electrical resistance is plotted up the ordinate; and the characteristic curve comprises:

a first straight line segment of ordinate value equal to the predetermined maximum value for DC electrical linear resistance, Ro, up to the cutoff frequency Fc; and then a second straight line segment representing a constant rate of increase up to the maximum frequency for electromagnetic radiation of the conducted type.

Thereafter, a second set E2 is selected constituted by n2 groups of spindles (n2≦n1) and m2(m2≦m1) groups of wires per group of spindles in the first set E1 for which an optimum braiding angle AOP and a minimum shielding weight MA are selected.

Under these conditions, the possible solutions correspond, for example, to the following six combinations C2:

| Harness diameter | n2 = 3 | | | | | |
|---|---|---|---|---|---|---|
| | 16 spindles | | | 32 spindles | | 48 spindles |
| dα | m2 = 3 | | | m2 = 2 | | m2 = 1 |
| | 6 strands | 7 strands | 8 strands | 6 strands | 7 strands | 6 strands |

The method of the invention is repeated for each consecutive diameter of electrical conductor bundle in said series s1.

For example, with two other diameters dβ and dγ where dα<dβ<dγ, a series s1 is determined such that at the end of the second step II, the solutions relating to the diameters dβ and dγ are as follows (with single and double prime symbols ' and " relating respectively to the diameters dβ and dγ):

| Harness diameter | n2' = 3 | | | | | | | |
|---|---|---|---|---|---|---|---|---|
| | 16 spindles | | | | 32 spindles | | 48 spindles | |
| dβ | m2' = 4 | | | | m2' = 2 | | m2' = 2 | |
| | 6 strands | 7 strands | 8 strands | 9 strands | 7 strands | 9 strands | 6 strands | 7 strands |
| dγ | m2" = 3 | | | | m2" = 2 | | m2" = 1 | |
| | 6 strands | 7 strands | | 9 strands | 6 strands | 7 strands | | 6 strands |

In a third step III, for each electrical conductor bundle diameter, a single group of spindles and a single braiding wire group are selected from those obtained in said second set, together with the single corresponding braiding angle, so as to minimize the number of combinations of spindle groups and braiding wire groups, with a different combination being allocated to each different series of consecutive diameters of electrical conductor bundles.

Thus, the above example shows that the solution comprising 48 spindles and 6 strands is common to each of the diameters dα, dβ, and dγ for electrical conductor bundles. This is thus the only solution that can be retained for said diameters, insofar as this solution corresponds to a minimum shielding weight for the intended applications comprising a plurality of harnesses corresponding to those various diameters. In practice, no intervention will be needed for braiding shielding sheaths having the diameters dα, dβ, or dγ: no change of spindle or reel groups, nor any change of wire groups needs to be made, only the braiding angle needs to be modified and that can be done automatically by applying a command to the braiding machine as summarized below;

| Harness diameter | Optimum braiding angle |
|---|---|
| dα | AOP = 31° |
| dβ | AOP = 32° |
| • | • |
| • | • |
| • | • |
| dγ | AOP = 35° |

Consequently, for the series s1 of harness diameters, a single combination is obtained corresponding to one group of spindles (the group N of 48 spindles) associated with one group of wires (the group M of 6-strand wire) instead of one combination for each harness diameter.

An extract from a specific application is given below:

| | | | |
|---|---|---|---|
| ... | ... | ... | ... |
| d1 | 16 | 6 | 39.2° |
| d2 | 16 | 6 | 39.2° |
| d3 | 16 | 6 | 39° |
| d4 | 16 | 6 | 39.9° |
| d5 | 16 | 7 | 35.5° |
| d6 | 16 | 7 | 45.6° |
| d7 | 16 | 7 | 46° |
| ... | ... | ... | ... |

In which:

the first column gives harness diameter, in order of increasing diameter from d1 to d7;

the second column gives the number of spindles;

the third column gives the number of strands; and the fourth column gives the braiding angle.

In this specific application, it turns out that making sheaths for seven different diameters of harness requires no changes to the group of spindles (one single group of 16 spindles), and requires only one change in the groups of wires and thus of reels when going from braiding with 6-strand wires to braiding with 7-strand wires. Specifically, there are only two combinations C covering 7 different diameters:

one combination comprising a group of 16 spindles, each reel on each spindle being provided with a 6-strand wire for braiding; and one combination comprising a group of 16 spindles, each reel on each spindle being provided with a 7-strand wire for braiding.

Naturally, the present invention can be subjected to a wide variety of implementations. Although one implementation is described above, it will readily be understood that it is not conceivable to identify exhaustively all possible configurations. Naturally, it is possible to envisage replacing any of the means described by equivalent means without going beyond the ambit of the present invention.

What is claimed is:

1. A method of optimizing setting parameters for a braiding machine fitted with spindles, themselves provided with reels of braiding wires constituted by strands of a particular material for braiding a shielding sheath of determined diameter on bundles of electrical conductors, said setting parameters comprising a plurality of groups of spindles, and a plurality of groups of braiding wires, wherein:

A/ in a first step I, for each diameter of electrical conductor bundle, a first set (E1) of spindle groups and of braiding wire groups is determined for which a range (P) of braiding angles is defined specifically for each wire, each range (P) firstly being defined by minimum and maximum braiding angles (AMI, AMA) lying in a predetermined range of braiding angles (PDT), and secondly corresponding to a predetermined maximum value (Ro) for the DC linear electrical resistance and to a predetermined minimum value for the optical coverage percentage (Kc);

B/ in a second step II, for each diameter of electrical cable bundle and for each spindle group associated with each of the braiding wire groups in said first set (E1), it is verified that the corresponding transfer impedance, for each braiding angle lying in said range (P), lies below a characteristic curve (G) representing the variation in an upper limit for transfer impedance as a function of the frequency of conducted type electromagnetic radiation, and a second set (E2) of spindle groups and of braiding wire groups is selected from said first set (E1), so that an optimum braiding angle (AOP) corresponds to a minimum weight for the shielding sheath; and C/ in a third step III, for each diameter of electrical conductor bundle, a single spindle group and a single braiding wire group is selected from those obtained in said second set (E2) together with the corresponding single braiding angle so as to minimize the number of combinations (C) of spindles groups and of braiding wire groups, a different combination (C) being allocated to each different series of consecutive diameters of electrical conductor bundles.

2. A method according to claim 1, wherein the predetermined maximum value (Ro) of the DC electrical linear resistance corresponds to operating conditions of a shielding sheath while in the new state.

3. A method according to claim 1, wherein the predetermined maximum value (Ro) of the linear electrical resistance lies substantially in the range 5 mΩ/m to 200 mΩ/m.

4. A method according to claim 1, wherein the predetermined minimum value for the optical coverage percentage (Kc) is substantially 50%.

5. A method according to claim 4, wherein the value of the optical coverage percentage (Kc) is preferably 80%.

6. A method according to claim 1, wherein the predetermined range of braiding angles (PDT) lies in the range 10° to 80°.

7. A method according to claim 1, wherein said characteristic curve (G), when plotted in a coordinate system having logarithmic scales to base 10 with transfer impedance plotted up the ordinate and electromagnetic radiation frequency plotted along the abscissa, comprises a first straight line segment of constant ordinate (Ro) up to the cutoff frequency (Fc), followed by a second straight line segment representing a constant rate of increase (TA) up to the maximum frequency (FM) for conducted type electromagnetic radiation.

8. A method according to claim 7, wherein the cutoff frequency (Fc) lies in the range 500 kHz to 10 MHz.

9. A method according to claim 8, wherein the cutoff frequency (Fc) is preferably about 1 MHz.

10. A method according to claim 8, wherein the maximum frequency (FM) is substantially 400 MHz.

11. A method according to claim 8, wherein the rate of increase (TA) is preferably about 20 dB/decade.

12. A method according to claim 8, wherein said template (G) corresponds to operating conditions for a shielding sheath while in the new state.

13. A bundle of electrical conductors covered with a shielding sheath, and provided with at least one electrical connector at one of its ends, wherein the DC linear electrical resistance (Ro) of the shielding sheath is below a predetermined maximum value, the braiding angles of the braiding wires lie in a predetermined range of braiding angles (PDT), and the optical coverage percentage (Kc) of the shielding sheath is higher than a predetermined minimum value and varies as a function of distance from said connector, and wherein the linear elecrical resistance (Ro) lies substantially in the range 5 mΩ/m to 200 mΩ/m, the predetermined range of braiding angles (PDT) lies in the range 10° to 80°, and the optical coverage percentage (Kc) varies from substantially 100% at said connector to substantially 50% remote therefrom.

* * * * *